US006158340A

United States Patent [19]

Venturati

[11] Patent Number: 6,158,340

[45] Date of Patent: Dec. 12, 2000

[54] PROCESS FOR PREPARING REMOVABLE METAL SLEEVES FOR GRAVURE PRINTING MACHINES

[75] Inventor: Lura Teresa Venturati, Rho, Italy

[73] Assignee: Rotoincisa S.R.L., Rho, Italy

[21] Appl. No.: 09/117,727

[22] PCT Filed: May 24, 1996

[86] PCT No.: PCT/IT96/00105

§ 371 Date: Aug. 5, 1998

§ 102(e) Date: Aug. 5, 1998

[87] PCT Pub. No.: WO97/33759

PCT Pub. Date: Sep. 18, 1997

[30] Foreign Application Priority Data

Mar. 14, 1996 [IT] Italy ..... MI96A000492

[51] Int. Cl.[7] ..... B41F 13/11; C25D 7/04

[52] U.S. Cl. ..... 101/170; 492/58; 205/127

[58] Field of Search ..... 101/150, 153, 101/170, 375, 401.1; 492/18.4, 48, 54, 57, 58; 205/127

[56] References Cited

U.S. PATENT DOCUMENTS

| | | | |
|---|---|---|---|
| 3,947,330 | 3/1976 | Heidenberger | 205/127 |
| 4,197,798 | 4/1980 | Bardin | 101/153 |
| 4,556,610 | 12/1985 | Van Heuvelen | 101/153 |
| 4,812,219 | 3/1989 | Sattrup et al. | 101/375 |
| 5,168,808 | 12/1992 | Prem | 101/375 |
| 5,974,972 | 11/1999 | Van Denend et al. | 101/375 |

FOREIGN PATENT DOCUMENTS

| | | | |
|---|---|---|---|
| 9360 | 4/1980 | European Pat. Off. . | |
| 92285 | 10/1983 | European Pat. Off. . | |
| 3042490 | 6/1982 | Germany | 101/170 |
| 3138164 | 4/1983 | Germany | 101/170 |
| 189995 | 8/1986 | Japan . | |
| 87-03843 | 7/1987 | WIPO . | |
| 94-27831 | 12/1994 | WIPO . | |

*Primary Examiner*—Stephen R. Funk
*Attorney, Agent, or Firm*—Michael J. Striker

[57] ABSTRACT

A process for preparing removable metal sleeve for gravure printing machines has been carried out in which after treating the lateral surface of the cylinder with a separator product and after associating protective strips in closure of the through holes of the lateral surface of the cylinder, the same is dipped into an electro-copper plating bath for forming a copper removable sleeve and axial removing of the copper sleeve is obtained by means of compressed air forced to form an air cushion between the cooper sleeve and the lateral surface of the cylinder and by means of a separator product used between the same copper sleeve and the cylinder.

3 Claims, 4 Drawing Sheets

Fig. 4
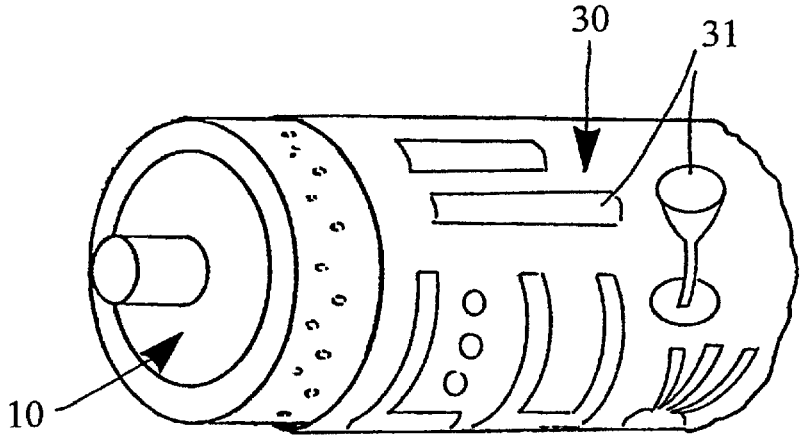
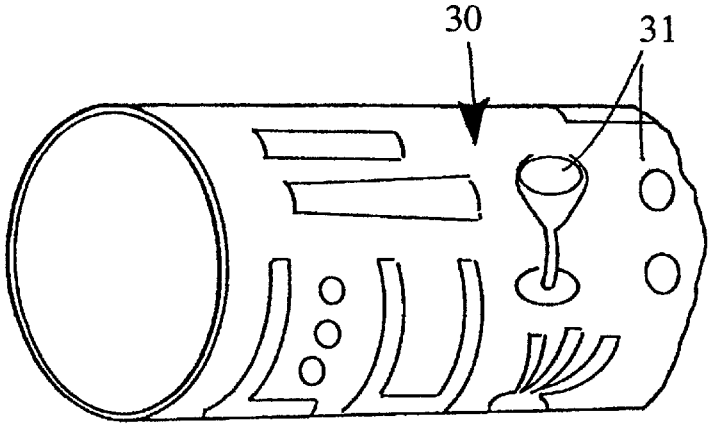
Fig. 5
Fig. 6
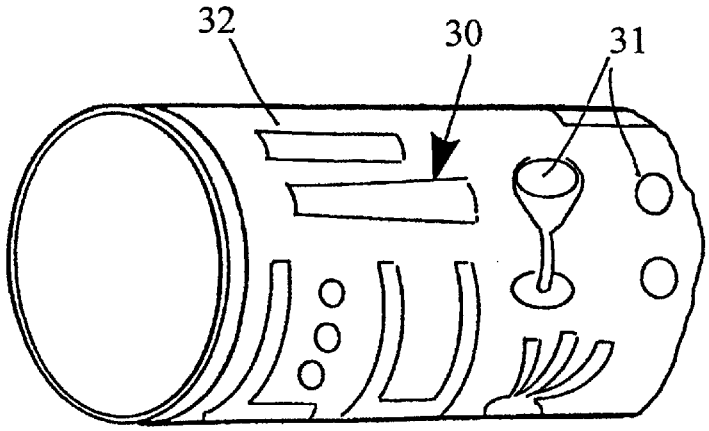

PROCESS FOR PREPARING REMOVABLE METAL SLEEVES FOR GRAVURE PRINTING MACHINES

FIELD AND BACKGROUND OF THE INVENTION

In gravure printing a cylindrical form is used to print what is desired and this is done by a photoengraving process during which tiny cells are formed that receive the ink subsequently transferred onto paper.

The surface on which these cells are engraved by various methods—traditional, halftone, conversion, electronic etc.,—is generally of copper. Said surface is obtained by galvanic deposition on steel cylinders and, after photoengraving, is given a chromium protective process.

For each fresh set of pictures the cylinders are processed by specialized engravers and are then sent to the user who mounts them onto machines for gravure printing.

Bearing in mind the considerable size and weight of each cylinder as well as the great delicacy of the surfaces, already engraved or prepared for it, there are clearly problems of transport and storage with related costs and capital tied up for the purpose.

To overcome these drawbacks and lower costs, metal cylindrical sleeves, usually nickel, are used, to slide on and off the cylinders.

A coating of copper, like that deposited on traditional cylinders, is deposited on the surfaces of these sleeves for good engraving results. There are a various methods for assisting the work of removing sleeves from these cylinders. The best known comprises having small holes made in the surface of the cylinder to permit creation of a cushion of compressed air between the surface of the cylinder and that of the sleeve.

Considering the great difference between the weight of a sleeve, 2–3 kg., and that of the cylinder, 100–200 kg., it is clearly advantageous to have a removable sleeve rather than a conventional type of cylinder. Running costs for corrections, balancing, maintenance, staff and transport are all reduced.

The quality of print is higher, while adjusting movements are avoided as well as waste of costly materials.

In the present situation of the market, however, requiring a greater variety of packing materials, which in turn means shorter printing runs and the ever present need to lower costs to increase competitivity, the fact that sleeves still have to be eliminated after use remains a serious loss and has a negative effect on the market.

A process has therefore been devised whereby a copper film is formed on the nickel sleeve and a separator product interposed between the two so that the film can easily be slid off when a new engraving is required. A fresh film for a fresh engraving is then deposited by electroplating on the nickel sleeve.

The separator product generally consists of a silver-based solution or of passivating substances, bichromates or some others. According to a preferred method a copper film and the separator product are applied to the nickel sleeve followed by formation of the copper film to be photoengraved.

To detach the copper film from the sleeve, for a fresh photoengraving process, use has to be made of mechanical means.

After this a new film is deposited following application of the separator. This process offers considerable advantages compared with direct deposition on the cylinder of the film to be photoengraved.

Even so, however, sleeve costs are high because of the high cost of nickel and because of the time needed to form the different layers: the copper film, the separator product and the copper film for engraving.

OBJECTS OF THE INVENTION

The invention here described appreciably lowers costs of removable sleeves both as regards materials and the time needed for applying them and therefore offers considerable economic and practical advantages as will be explained below.

SUMMARY OF THE INVENTION

Subject of the invention is a process for preparation of metal sleeves for photoengraving, removable from the cylinder on gravure printing machines.

The removable sleeve is constructed of copper and engraving is done directly onto said sleeve.

The copper sleeve is created on a cylinder by its immersion in an electro-copper plating bath.

Before being put into the plating bath the cylinder is treated with a separator product to facilitate detachment of the sleeve.

Once engraved the copper sleeve can be used for further engraving by mechanical removal of the engraved layer.

After formation of the copper sleeve, according to one advantageous application of the process, the separator product is once again applied to the base formed by said sleeve and then a copper film is formed in the electroplating bath on said base.

In this way, in order to make a fresh engraving, the copper film is removed from the sleeve with or without mechanical means.

By interposing a separator product, a new film can be formed and a fresh engraving be made in the electroplating bath.

The separator product is preferably an aqueous solution of silver salts. This solution of silver salts is that given by an exhausted solution used to fix films in the engraving process on copper sleeves, loaded with silver salts which have not been darkened by photographic development and removed during the fixing process.

It is an advantage if the cylinder exhibits a device able to create an air cushion to assist in sliding the sleeve off the cylinder.

The invention offers evident advantages.

Elimination of the nickel base and copper film, replacing said base by a copper sleeve, not only drastically reduces costs of materials but also working times and simplifies operations.

Photoengraving onto an entirely copper sleeve is much quicker and easier.

If, by interposition of a separator product, a copper film is formed on the copper base, a further advantage is gained as removal of the copper film for each fresh photoengraving process can be done simply and quickly. It will be seen from the foregoing that removable sleeves offer a great many advantages compared with directly photoengraved cylinders both from the point of view of cost and from that of simplifying operations.

BRIEF DESCRIPTION OF THE DRAWINGS

Characteristics and purposes of the invention will be made still clearer by the following examples of its execution illustrated by diagrammatically drawn figures.

FIG. 4 The cylinder with its copper sleeve after photoengraving.

FIG. 5 The engraved sleeve removed from the cylinder.

FIG. 6 Sleeve with chromium finish, ready for gravure printing.

DESCRIPTION OF THE PREFERRED EMBODIMENT

Figure 1:
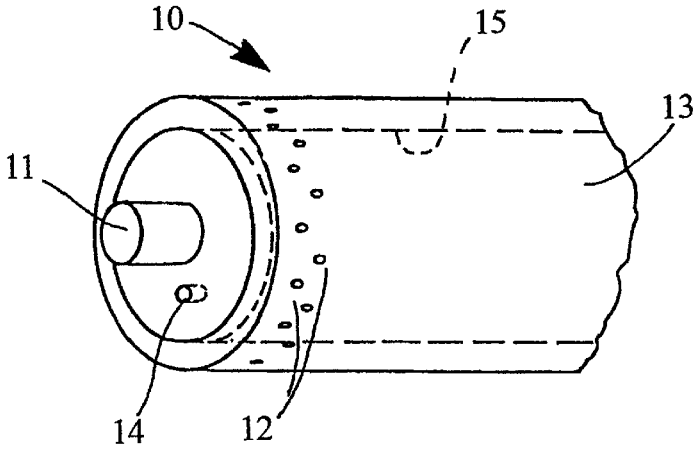
FIG. 1 Perspective of a cylinder for creating an air cushion for formation of a copper sleeve.
Figure 2:
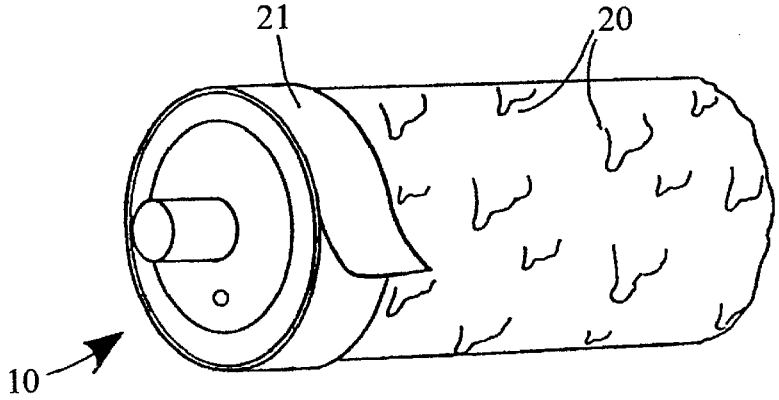
FIG. 2 The cylinder in FIG. 1 treated with a solution of separator product.
Figure 3:
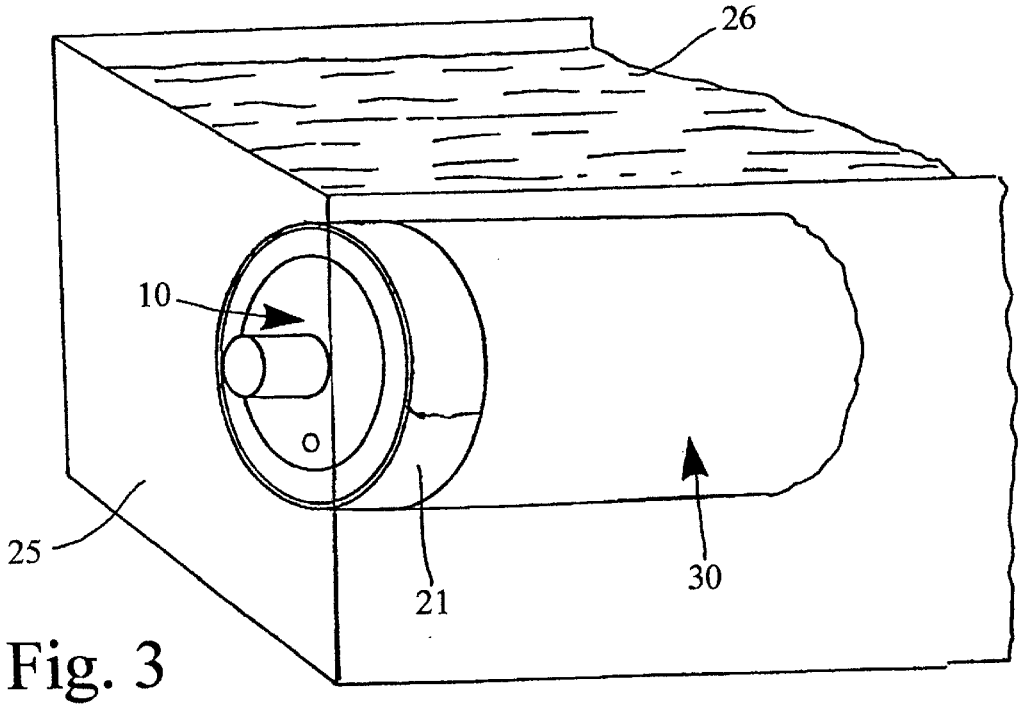
FIG. 3 The wet cylinder in a bath for electro copper plating.
Figure 7:
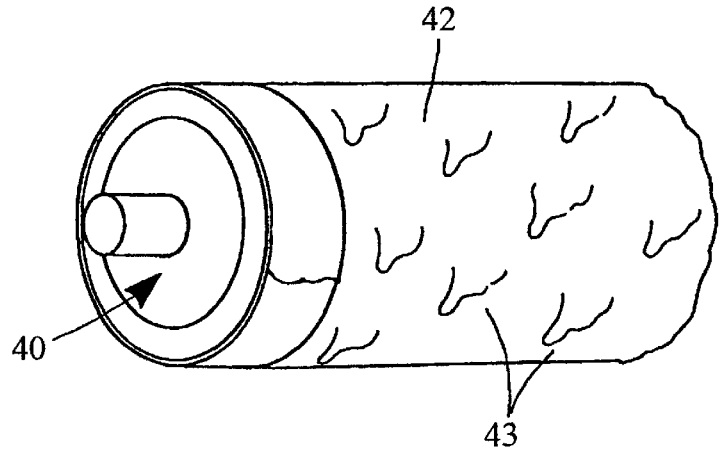
FIG. 7 The cylinder after receiving a layer of electrocopper plating, given a new treatment with a separator product.

In the cylinder 10 with pins 11 are small holes 12 on the surface 13, communicating with the inner chamber 15 in which there is a lateral mouth 14 for passage of compressed air to create an air cushion when the copper sleeve, to be formed round said cylinder, is being taken off. The cylinder is treated with a solution 20 of separator product as seen in FIG. 2 and, after application of lateral protective strips 21 on the perforated area, is immersed in the liquid 26 in the bath 25 for electro copper plating.

The copper sleeve 30 having been formed, the cylinder is extracted for the photoengraving process of objects 31 as seen in FIG. 4.

The engraved sleeve 30 is then removed (FIG. 5), this action being assisted by presence of the separator product 20 and by the air cushion created by compressed air put into the chamber 15, after which the sleeve 30 is given a protective chromium coating 32 (FIG. 6).

The sleeve is then sent away for gravure printing where it will be mounted on the cylinders of the printing machine.

At the end of the printing run the sleeve can be returned to its owners who do the photoengraving.

According to its thickness the sleeve can be remelted or the engraved layer can be removed, the surface smoothed and the sleeve be used again for further engraving.

Alternatively, the sleeve can be formed on a cylinder 40 by a layer of copper 42, with interposition of a separator product.

Figure 8:
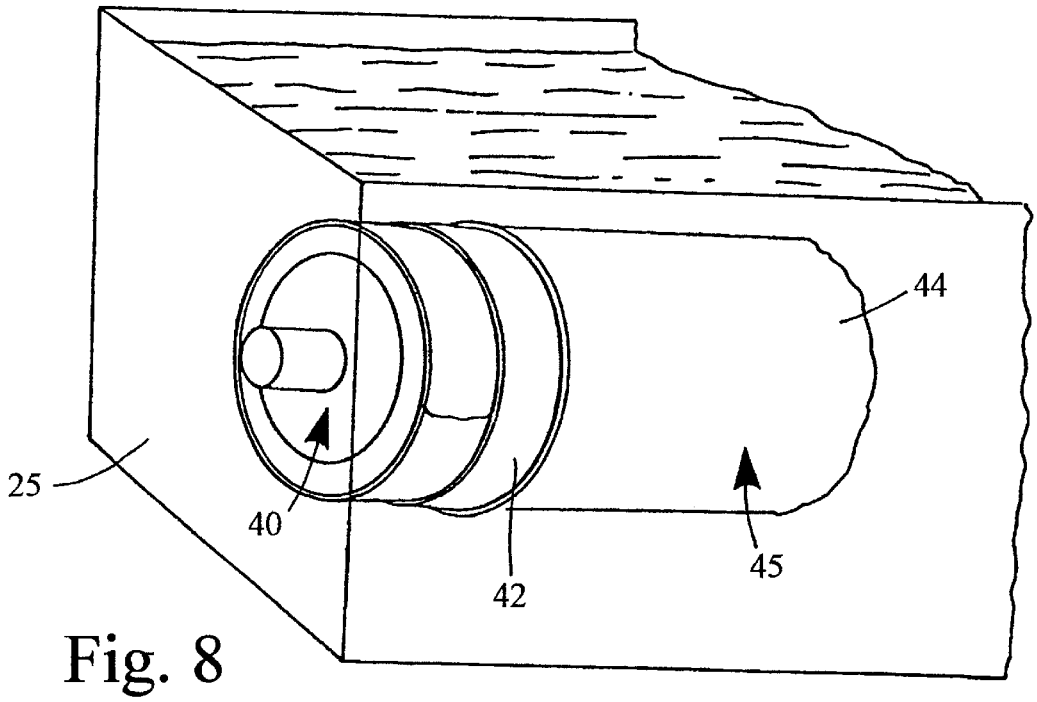
FIG. 8 The cylinder in FIG. 7 put back into the plating bath for formation of a copper film, at the end of that process.

The cylinder 40 is given a new bath of separator product 43 and once more placed in the copper plating bath 25 for formation of a copper film 44 to make a sleeve 45 (FIG. 8).

Figure 9:
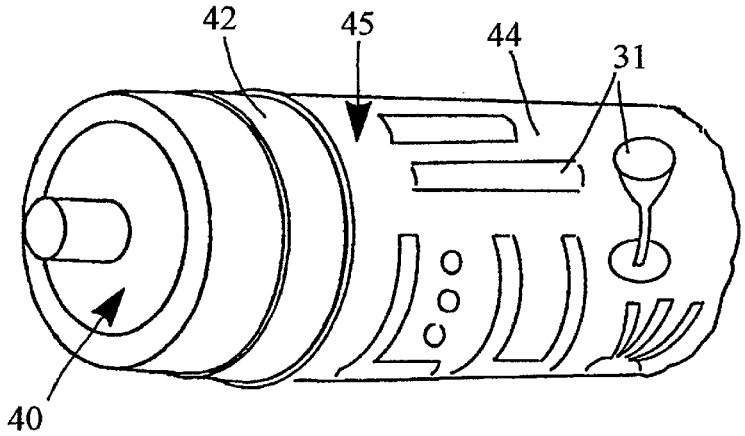
FIG. 9 The cylinder in FIG. 8, taken from the bath, after photoengraving.
Figure 10:
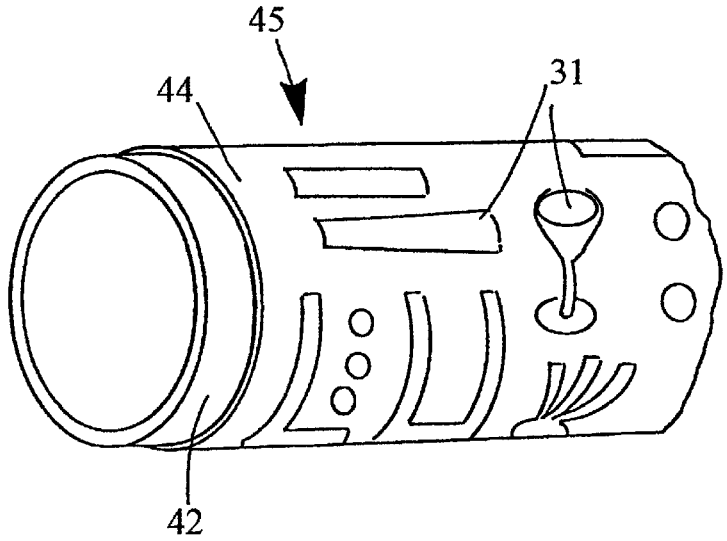
FIG. 10 The sleeve of the cylinder in FIG. 9, removed and ready for gravure printing.
Figure 11:
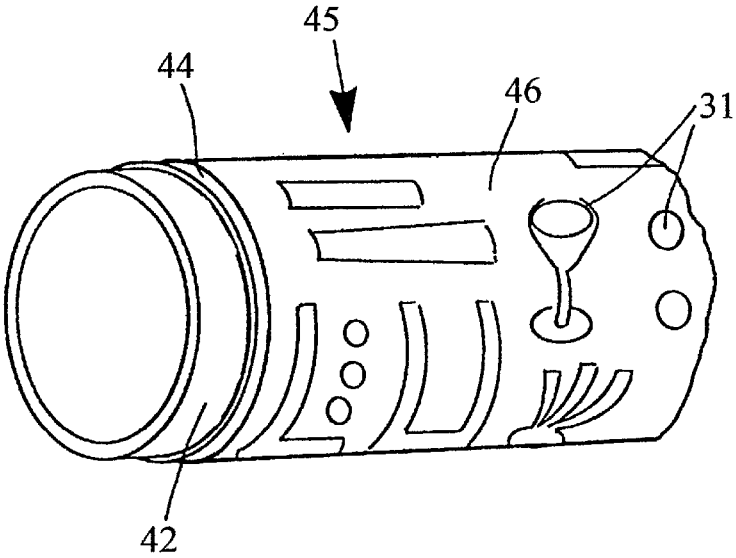
FIG. 11 The sleeve in FIG. 10 having received a protective chromium coating.

This film is then photoengraved with the desired design 31 (FIG. 9), the sleeve is removed from the cylinder (FIG. 10) and after receiving a protective chromium coating 46 (FIG. 11), is sent to the printers.

Figure 12:
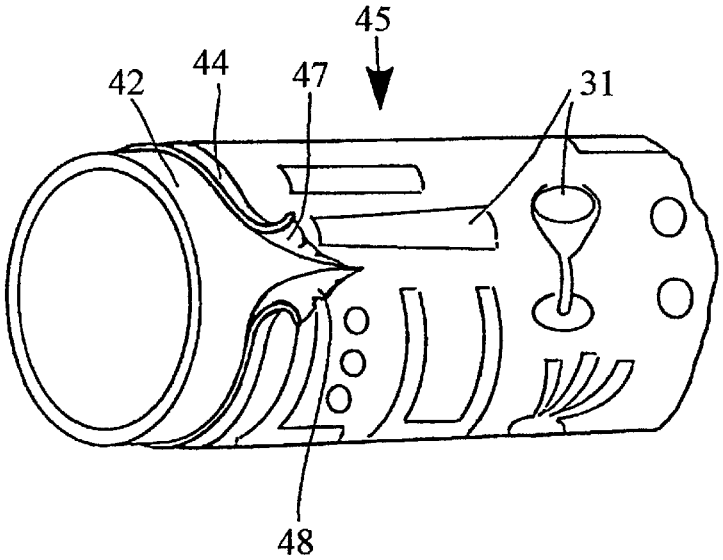
FIG. 12 The sleeve at the end of printing when the photoengraved film is being removed to permit formation of a new copper film ready for photoengraving.

On completion of the printing run the sleeve 45 is returned to the engraver who can engrave a new design, detaching the film 44 using mechanical means to do so if required, as shown in FIG. 12 where the edges 47, 48 of the film 44 may be seen in the process of removal.

This having been done, and always with interposition of a separator product, a new film can be formed for a fresh engraving.

Normal photoengraving work comprises preparation of the photographic material for engraving by chemical or by electromechanical methods. For fixing the photographic film, different solutions are used containing, for example, sodium hyposulphite, bisulphite, ammonium thiosulphate.

These solutions remove the unoxidised silver salts from photographic development. When this solution is exhausted it will contain a high proportion of silver salts and is therefore sold to engravers who use it as a suitable separator product to interpose between the cylinder and the copper sleeve or between the copper film and the thicker layer of copper in the case of sleeves on which that layer and film are used.

What is claimed is:

1. Process for preparing removable metal sleeves for gravure printing machines comprising the following steps:

preparing a cylinder (10, 40) having a lateral surface (13);

treating the lateral surface (13) of the cylinder (10) with a separator product (20) comprising an aqueous solution of silver salts, said solution being an exhausted solution previously used as fixer of a photographic film in a photoengraving process on a different copper sleeve, said exhausted solution being charged with unoxidized silver salts from photographic developing process and removed during a fixing operation;

dipping said cylinder (10, 40) in an electro-copper plating bath (25);

forming a copper sleeve (30) directly on the lateral surface (13) of the cylinder (10, 40);

extracting the cylinder (10, 40) from the electro-copper plating bath;

axially removing the copper sleeve (30) from the cylinder (10, 40) by means of the separator product (20) interposed between the copper sleeve (30) and said lateral surface (13) of the cylinder (10, 40); and photoengraving a design (31) directly on said copper sleeve (30).

2. Process according to claim 1, further comprising, after the forming step, the steps of:

treating an external surface of the copper sleeve (30) with the separator product (20);

dipping said cylinder (10; 40) carrying the removable copper sleeve (30) with the separator product (20) in the electro-copper plating bath (25);

forming a copper film (44) upon said copper sleeve (30), the separator product (20) being interposed between the copper film (44) and the copper sleeve (30) and between the copper sleeve and the cylinder (10; 40).

3. Process according to claim 2, further comprising the step of mechanically removing the copper film (44) from the copper sleeve (30).

* * * * *